US006073673A

United States Patent [19]

Janutta

[11] Patent Number: 6,073,673

[45] Date of Patent: Jun. 13, 2000

[54] WALL OR PARTITION SYSTEM FOR USE IN BUILDINGS TO DIVIDE LARGE SPACES INTO SMALLER SPACES, WHICH WALL OR PARTITION SYSTEM HAS A HINGE FOR CONNECTING ADJACENT WALL OR PARTITION ELEMENTS

[75] Inventor: Reinhard Janutta, Verl, Germany

[73] Assignee: DORMA GmbH + Co. KG, Ennepetal, Germany

[21] Appl. No.: 09/166,834

[22] Filed: Oct. 5, 1998

Related U.S. Application Data

[63] Continuation-in-part of application No. PCT/EP98/00615, Feb. 5, 1998.

[30] Foreign Application Priority Data

Feb. 7, 1997 [DE] Germany ..... 197 04 490

[51] Int. Cl.[7] ..... E05D 15/26

[52] U.S. Cl. ..... 160/199; 160/135; 160/229.1; 16/370; 16/288

[58] Field of Search ..... 160/229.1, 199, 160/135, 220; 16/288, 366, 368, 370, 227, 365

[56] References Cited

U.S. PATENT DOCUMENTS 328,342 10/1885 Robinson .
2,135,280 11/1938 Erickson .
2,178,271 10/1939 Soss .
3,881,221 5/1975 Schmidt .
4,995,144 2/1991 Gately .
5,410,779 5/1995 Esman et al. .
5,537,766 7/1996 Nickens .

FOREIGN PATENT DOCUMENTS 0528032 2/1993 European Pat. Off. .

*Primary Examiner*—Blair M. Johnson
*Attorney, Agent, or Firm*—Nils H. Ljungman & Associates

[57] ABSTRACT

Movable partition elements and a hinge to connect the partition elements to each other. The partition elements can be swung on the hinge toward one another until they are substantially parallel to each other. The hinge can have stacked or crossed connecting arms seated in or braced against connecting elements attached to the partition elements. The hinge can also have a retainer which passes through a penetration in each of the connecting elements. The retainer can be inserted into or connected to the partition elements by the retainer shank. The retainer further can separate the connecting arms from each other. The retainer finally can be designed to form or support the axle arms on which the connecting arms can rotate.

18 Claims, 5 Drawing Sheets

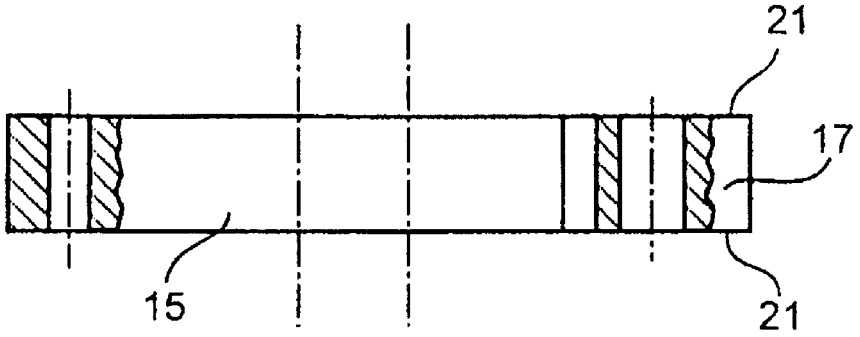
Fig 11
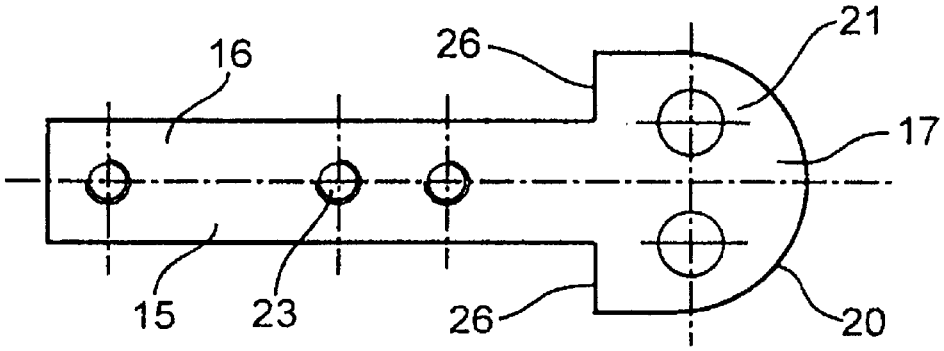
Fig 10
Fig 12
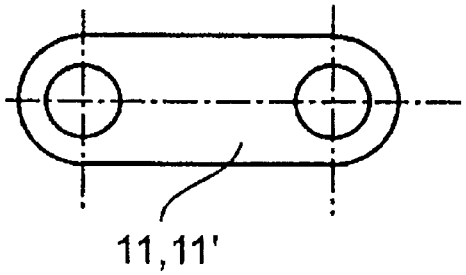
Fig 13
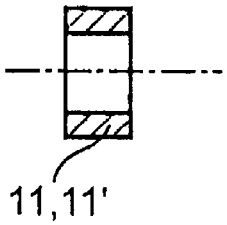

WALL OR PARTITION SYSTEM FOR USE IN BUILDINGS TO DIVIDE LARGE SPACES INTO SMALLER SPACES, WHICH WALL OR PARTITION SYSTEM HAS A HINGE FOR CONNECTING ADJACENT WALL OR PARTITION ELEMENTS

CONTINUING APPLICATION DATA

This application is a Continuation-In-Part application of International Application No. PCT/EP98/00615, filed on Feb. 5, 1998, which claims priority from Federal Republic of Germany Patent Application No. 197 04 490, filed on Feb. 7, 1997. International Application No. PCT/EP98/00615 was pending as of the filing date of the above-cited application. The United States was an elected state in International Application No. PCT/EP98/00615.

BACKGROUND OF THE INVENTION

1. Field of the Invention

The present invention relates to a hinge for connecting adjacent partition elements, which elements can be folded toward one another until they are substantially parallel to each other. These partition elements have connecting elements situated on the end faces of the partition elements. These connecting elements can be situated opposite each other between the partition elements. The connecting elements can be connected by crossed connecting rods seated in recesses of the connecting elements. The opposing end faces of the connecting elements can be substantially convex to permit a small air gap between them.

2. Background Information

A hinge of this type is disclosed in European Patent Application 0528 032 A1.

A hinge of this type may be further disclosed in U.S. Pat. No. 5,410,779, issued to inventors Esman et al. on May 2, 1995, which corresponds to European Patent Application 0528 032 A1.

With the hinge of the known art, the connecting elements are either removably fastened in the grooves of the hanger elements using bolts, or permanently fastened by welding. Connecting elements and hanger elements are thus realized as two distinct components. Although the stacked and crossed levers make it possible with the device of the known art to swing the adjacent door panels 360° or 380° into a position substantially parallel to one another without the formation of a significant air gap between adjacent door panels, the use of wood screws to connect the connecting elements and the hanger elements is a weakness which permits only the transmission of a slight force when swinging one door element toward the other door element. If the connecting element is welded to the hanger element, the connection is then permanent, which is disadvantageous for repairs or the replacement of individual elements. The solution disclosed in the publication cited above is therefore inapplicable for the transmission of greater forces such as those required in the case of heavy wall or door elements, e.g. glass doors.

OBJECT OF THE INVENTION

The object of the present invention is therefore to improve a hinge of the type cited above such that the transmission of greater forces is possible with correspondingly greater ease of maintenance and simple installation.

A further object of the present invention is to improve the hinge of a hanging partition element system to allow it to provide support to substantially heavy partition elements, such as those made of metal or glass, yet also permit such partition elements to be moved easily into a substantially parallel or folded position. The improved hinge can also allow easier repair, installation, and maintenance of the partition element system.

SUMMARY OF THE INVENTION

These objects can be realized in a hinge for connecting adjacent partition elements with connecting elements, such that the wall of the connecting element, which wall also forms the bottom of a recess or groove, has a penetration through which the retainer shank of a retainer is passed, which retainer shank can be fixed in or to the element or add-on pieces of the same, and the retainer has a retainer head which is wider than the retainer shank, which retainer head when resting on the bottom of the recess or groove serves as or supports the axle arms of the connecting rods.

The component herein referred to as the connecting element is both the connecting element for the connection of adjacent door or wall elements and the hanger element for the connection to the actual wall or door element. The components which European Patent Application 0528 032 A1 teaches are distinct are thus realized as a unit in the current invention.

The connecting element can therefore be designed to be appropriately robust, so that the shank of the sturdy retainer, which passes through the connecting element, extends sufficiently far into the wall or door element (or into a corresponding door rail), where it is fastened. Because the broadened head of the retainer is flush with the bottom of the groove in the connecting element, the distance between the two opposing connecting elements is precisely fixed. By fixing the retainer, i.e. the shank, the connecting elements are thus fixed both positively and non-positively in the wall or door element.

In other words, in one possible embodiment of the present invention, the connecting element can be designed to be appropriately strong and stable, so that the shank of the retainer, which can pass through the connecting element, may extend sufficiently far into the partition element, where it can be fastened. Because the broadened head of the retainer can be flush with the bottom of the groove in the connecting element, the distance between the two opposing connecting elements can be precisely fixed. By fixing the retainer, the connecting elements can then possibly be fixed in or on the partition element by essentially any type of connecting arrangement or structure, such as bolts, screws, pins, fasteners, welding, adhesive bonding, pressure fittings, clamps, splines, form fittings, and contour fittings. What can be meant by positively and non-positively connected in at least one embodiment of the invention is listed in the previous sentence.

The opposing outer surfaces of the retainer heads are matched to the opposing outer surfaces, i.e. the opposing end faces, of the connecting elements. This measure ensures that the air gap also remains small around the retainer heads, eliminating the risk of injury in the area of the linkage represented by the hinge.

One of every pair of crossed connecting rods can be seated in the groove between a plane surface of the retainer head and a plane surface of the connecting element. The two connecting rods are thus kept apart by the retainer head, therefore the fixed link between the upper and lower connecting rod disclosed in European publication 0528032A1 cited above is not necessary.

To achieve a good connection between the retainer shank and the wall or door element, or the door rail of the same, on the one hand, and to achieve a precise arrangement of the retainer shank in the connecting element on the other, the retainer shank can have a square or rectangular cross-section, and the penetration in the connecting element matches the cross-section of the retainer shank. The retainer shank preferably has corresponding bores, preferably threaded bores, for connection to the wall or door element or the door rail of the same.

Another significant feature of the invention is that the connecting elements are preferably divided into two mirror-image halves to each form one half of a convex end face, which halves can be bolted together. It is in the known art to preferably manufacture such known connecting elements of an aluminum alloy to exploit the benefits of a cost-effective, i.e. advantageous, manufacturing process which saves both weight and material.

Because the connecting elements can also serve simultaneously as the hanger element, the connecting elements can have a slot for a wall or door element, which slot can be preferably used to seat and hold a pane of glass.

European Patent Application 0528 032 A1 teaches that the opposing end faces of adjacent connecting elements are realized as hemi-ellipses with the stacked, crossed connecting rods arranged orthogonally to one another. Such hemi-ellipsoid contours are more costly and complex to produce than are circular contours.

As shown in the present invention, however, a small air gap with a constant width while swinging adjacent wall or door elements can be achieved if the connecting rods are crossed to form an X shape with an included angle of approximately 52° when the adjacent wall or door elements are flush, the central longitudinal axis of the wall or door elements forms the bisecting line or median line of the included angle, and the opposing end faces of the connecting elements can be semicircular.

The present invention creates a hinge of the type cited in the description which is particularly well-suited for connecting two relatively heavy adjacent wall or door elements, so that even repeated movement of the wall or door elements from the flush in-service position to a park position in which the wall or door elements are parallel to one another essentially does not result in wear in the area of the connecting elements or jamming.

The above discussed embodiments of the present invention will be described further hereinbelow with reference to the accompanying figures. When the word "invention" is used in this specification, the word "invention" includes "inventions," that is, the plural of "invention." By stating "invention," the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is described in greater detail below with reference to at least one possible embodiment as shown in the following drawings:

FIGS. 10 and 11 show the retainer;

FIGS. 12 and 13 show the connecting rod; and

DESCRIPTION OF THE PREFERRED EMBODIMENT

Figure 1:
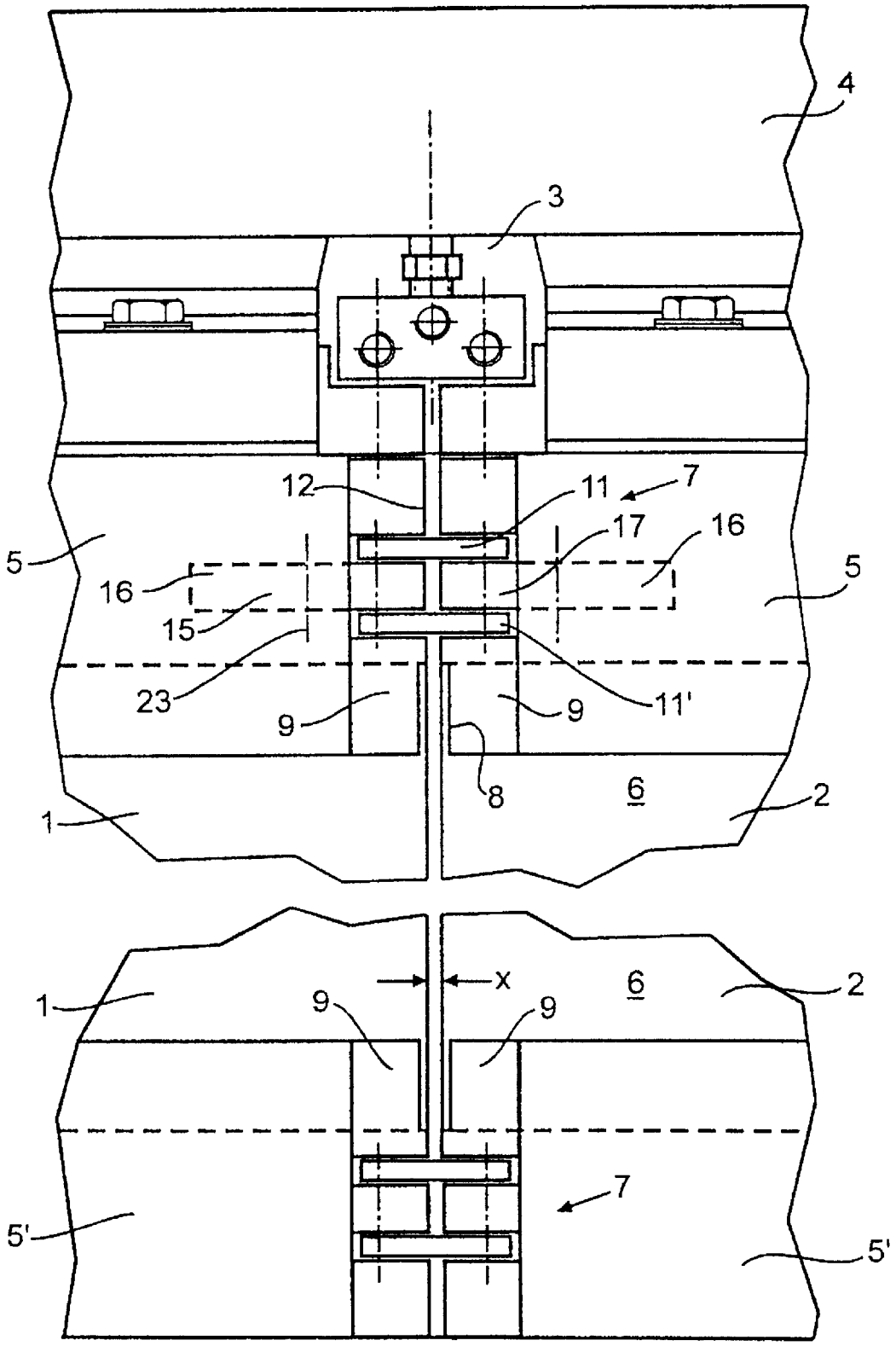
FIG. 1 shows a view of the upper and lower connection of two adjacent door elements.
Figure 2:
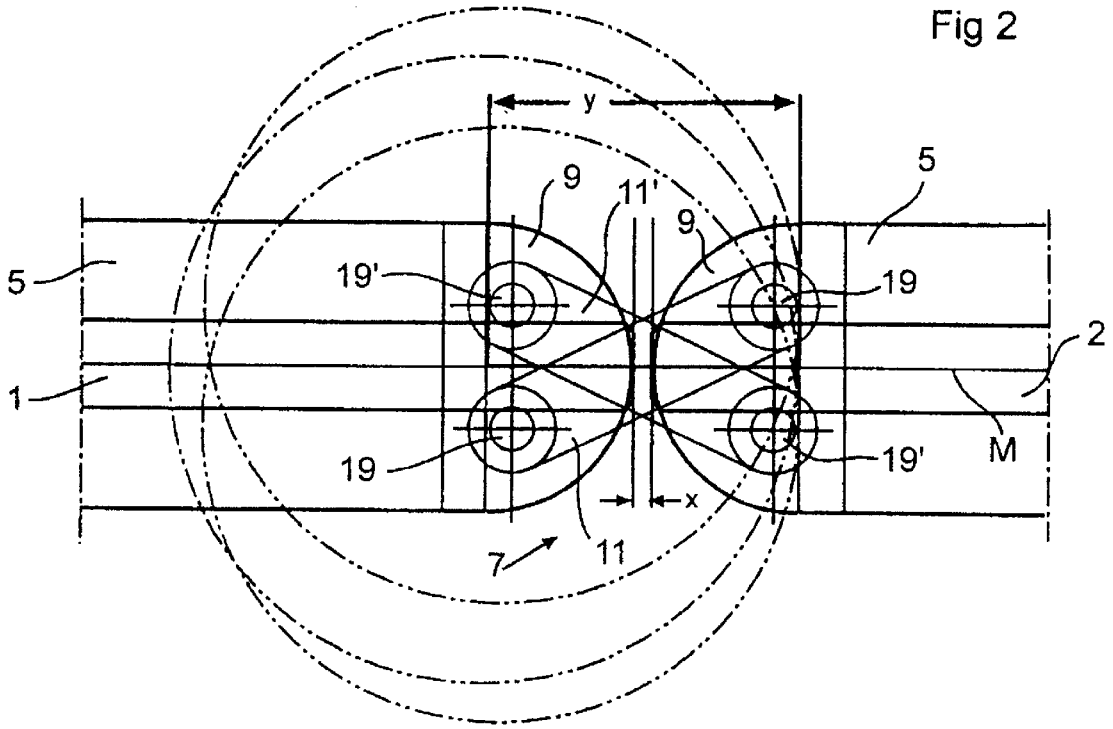
FIG. 2 shows a schematic plan view, enlarged relative to FIG. 1, of the linkage with flush door elements.
Figure 3:
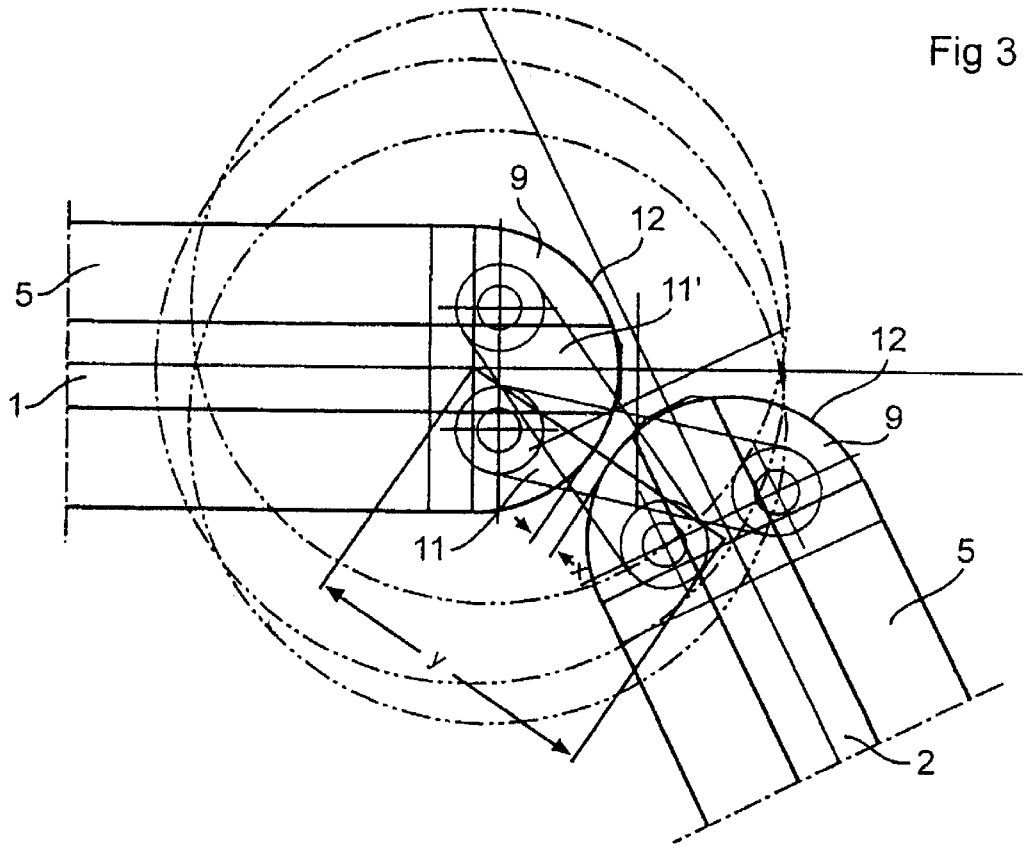
FIG. 3 shows the plan view as shown in FIG. 2 with the door elements at an angle to one another.
Figure 7:
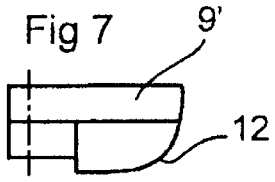
FIGS. 4–8 show various views of one half of a connecting element, shown slightly enlarged relative to FIG. 1.
Figure 6:
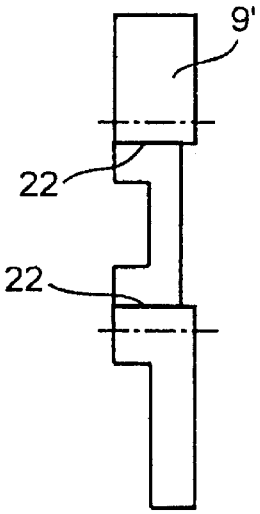
Figure 4:
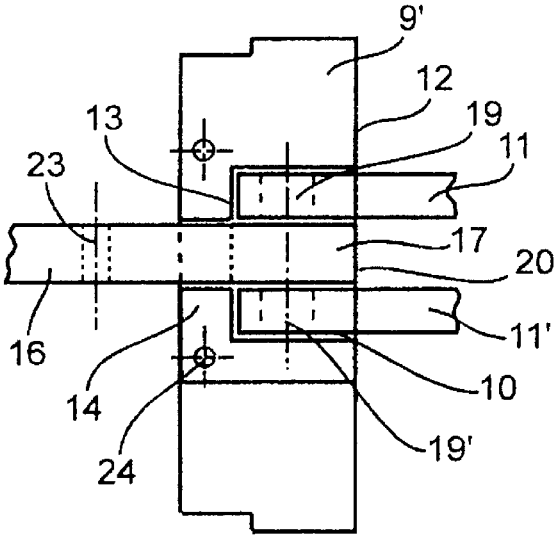
Figure 5:
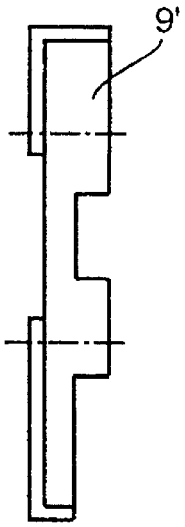
Figure 8:
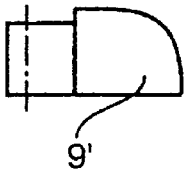

In FIGS. 1 through 3, the adjacent elements which in FIG. 1 comprise a pane of glass 6 are numbered 1 and 2. Elements 1 and 2 are mounted in a manner of the known art by means of a hanger element 3 so as to roll or slide in a runner rail 4. The hinge 7 is located in both an upper door rail 5 and a lower door rail 5'. FIGS. 1 through 3 also show that the opposing end faces 8 of the elements 1, 2 are separated by a small air gap X. As can further be seen in FIG. 1, connecting elements 9 in which the connecting rods 11, 11' are seated are located in the area of the door rails 5, 5'. Located between the two connecting rods 11, 11' is a retainer 15, whose retainer head 17 separates the two connecting rods 11, 11' and whose retainer shank 16 is connected to the door rail 5 and 5', respectively, via bores 23 in the retainer shank 16. One sees that essentially the same slight air gap X exists between the adjacent end faces 12 of the connecting elements 9 or the outer surfaces 20 of the retainer heads 17 as exists between the adjacent elements 1, 2.

To further explain, in another possible embodiment, the partition element system can possibly have a hanger element 3 that can be rotatable about a central axis. The structure of the hanger element 3 can be realized in essentially a three-dimensional rectangular shape with a bolt system to attach it to a roller mounting that can slide or roll in or on a guide rail or runner rail 4. The hanger element 3 can be oriented in a substantially parallel direction with respect to the guide rail 4 along the longitudinal axis of the rectangular structure of the hanger element 3. The bolt system can be attached in substantially a center portion of the rectangular structure and through the rectangular plane surface facing the guide rail 4. In one possible embodiment a bore hole can be drilled in the center portion and the bolt can be inserted or attached with a nut to the rectangular plane surface facing the guide rail. The bolt can then be attached to the roller mounting. The bolt could comprise a central axis, which axis runs substantially perpendicular to the rectangular plane surface facing the guide rail 4 and perpendicular to the guide rail 4 and about which central axis the hanger element 3 can rotate. The bolt can be designed so that the hanger element 3 can rotate a full 360° around the central axis.

In one possible embodiment the hanger element 3 can possibly further have two more bore holes drilled, one through each side of the rectangular plane surface opposite the rectangular plane surface facing the guide rail 4. These bore holes could handle a similar bolt or pin structure as used to attach the hanger element 3 to the roller mounting. The bore holes can be drilled at a substantially equivalent distance from the opposing edges of the rectangular plane facing opposite the guide rail 4, and a substantially equivalent distance from the center bore hole which is attached to the central bolt system. Bolts could again be inserted in or attached by a nut to each of the two bore holes. The bolts could then be inserted into the connecting element 9 or other connecting structure. The connecting element or structure 9 can be attached to a partition elements 1, 2. The bolts can be designed in the manner described above, in that they would allow the connecting element or structure 9 to rotate about the bolt's central axis in substantially a range of about 360°, and therefore allow the corresponding partition elements 1, 2 to do the same.

The multiple-rotation ability of the hanger element 3 can permit the movement of the connecting elements 9 and their corresponding partition elements 1,2 so that the connecting elements 9 and their corresponding partition elements 1,2 can be rotated or folded until they are in a substantially parallel position in relation to each other. The central bolt system is therefore essential to this function. If, for example, in one possible embodiment of the present invention, the hanger element 3 were attached to the roller mounting by a single, non-rotatable bolt or pin system, it would be impossible for the partition elements 1,2 to rotate 360°. Partition element 2 could possibly rotate a significant distance on its corresponding bolt, but would eventually be no longer able to rotate because it would run into the opposing element 1 attached to the hanger element 3.

In one possible embodiment of the present invention, the rotation of the hanger element 3 around the central bolt system can permit the hanger element 3 to move when one of the partition elements 1,2 rotates on its bolt. As the partition element 2 rotates toward the opposing partition element 1, the hanger element 3 can also begin to rotate, therefore permitting the longitudinal rectangular plane surface of the hanger element 3 to rotate from a direction substantially parallel to the guide rail 4, to a position where the longitudinal rectangular plane surface of the hanger element 3 runs perpendicular to the guide rail 4. The rotating partition element 2 can now continue to rotate about the axis of its corresponding connecting bolt since the axis has been moved around the obstruction caused by the opposing partition element 1.

Examples or samples of further possible embodiments of a hanger element 3 of the type described above can be obtained from the Dorma GmbH+Co. KG, Postfach 40 09, D-58247 Ennepetal, Federal Republic of Germany, which manufactures partitions, both fixed and movable, and devices and mechanisms associated with partitions, such as hanger elements.

The linkage shown in FIGS. 2 and 3 clearly shows the two crossed, stacked connecting rods 11, 11'. The upper connecting rod 11 is mounted in the axle arm 19 and the lower connecting rod 11' is mounted in the axle arm 19'. The functional principle of such a linkage is disclosed in European Patent Application 0528-032A1.

As shown in FIG. 2, the two connecting rods 11, 11' are crossed to form an X with an included angle of approximately 52° when the elements 1, 2 are flush, and the bisecting line of this angle is formed by the center longitudinal axis M of the elements 1, 2. The opposing end faces 12 of the connecting elements are semicircular.

Because the distance Y between the centers of the circles of the aforementioned semicircles remains unchanged even when swinging element 2 toward another element 1, the air gap X likewise remains unchanged.

FIGS. 4 through 8 show one half 9' of a connecting element 9. The half 9' of the connecting element has a recess or groove 10, the bottom 13 of which delimits a wall 14 of the half 9' of the connecting element 9. The wall 14 has a square penetration 18, through which the likewise square retainer shank 16 is passed. A broadened retainer head 17 of the retainer 15 rests with its supporting surfaces 26 flush on the bottom 13 of the recess or groove to form a positive and non-positive connection when the connecting element is mounted. At the same time, the retainer head 17 separates the two connecting rods 11, 11', with the connecting rods 11, 11' braced on one side against plane surfaces 22 of the connecting element 9 and on the other side against plane surfaces 21 of the retainer head 17 (see FIG. 11). The outer surface 20 of the retainer head 17 is realized with the same contour as the end face 12 of the connecting element 9. The upper connecting rod 11 as seen in the figure is rotated by means of an axle arm 19; the lower connecting rod 11' as seen in the figure is rotated by means of an axle arm 19', with the axle arms 19, 19' preferably being integral components of the retainer 15, i.e. preferably are non-rotationally connected to the retainer 15.

Figure 9:
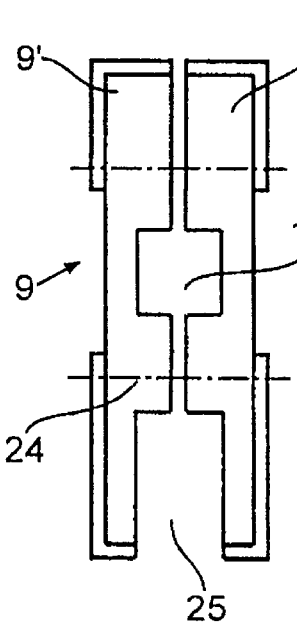
FIG. 9 shows a view of two halves as shown in FIGS. 4 through 8 joined to form a connecting element.

As shown in FIG. 9, the two halves 9, 9' are joined by means of bolts in the bores 24 (not shown) to form a connecting element 9. Also visible is a slot 25, which in this embodiment is used to seat and hold a pane of glass comprising element 1

FIGS. 10 and 11 show a schematic of one embodiment of the retainers 15.

FIGS. 12 and 13 show a schematic of one embodiment of the connecting rods 11, 11'.

Figure 14:
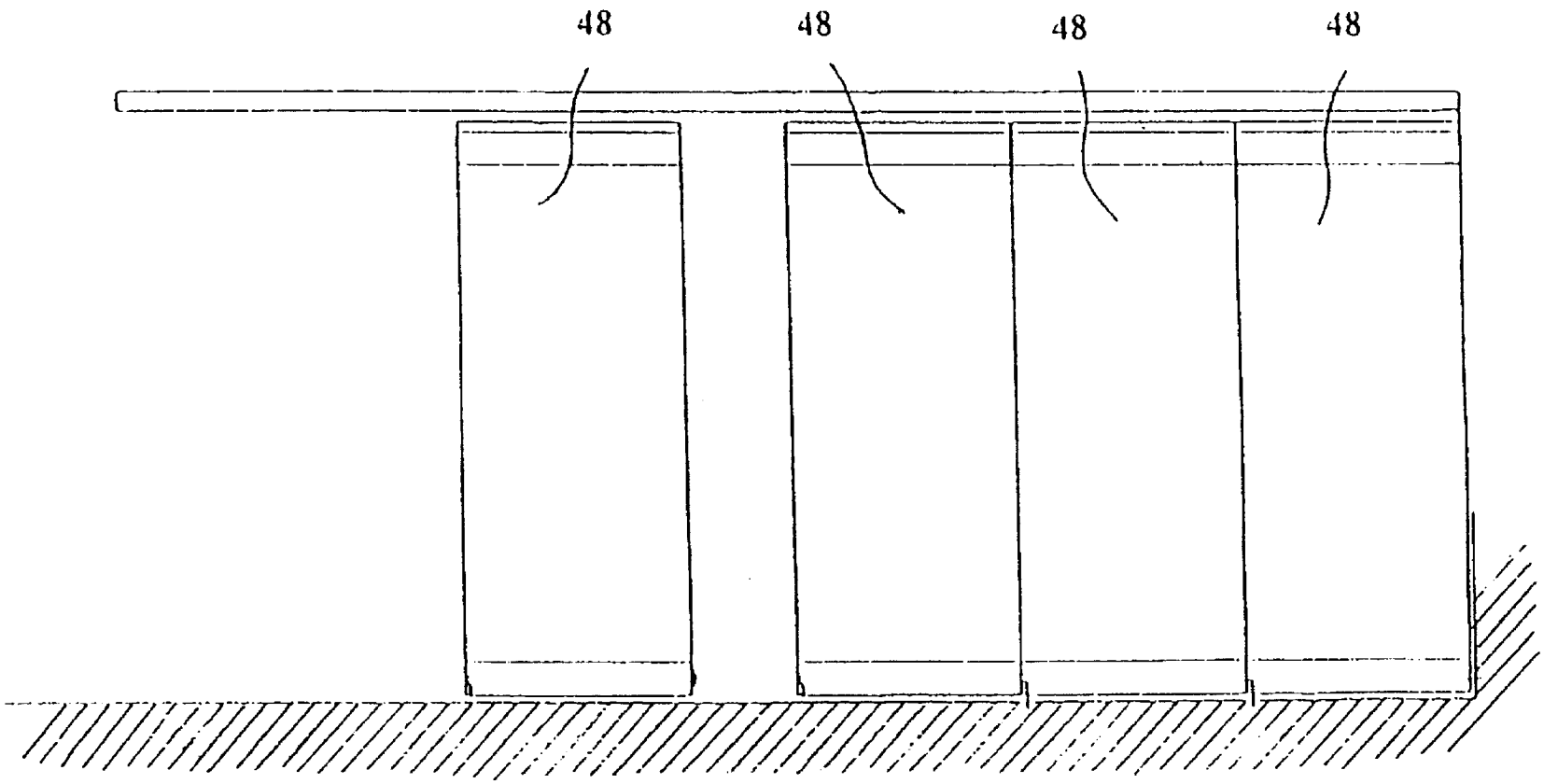
FIG. 14 shows one possible embodiment of partition elements in a movable partition system or wall.

FIG. 14 shows one possible embodiment of partition elements 48 as part of a movable partition system or wall, in which the present invention could possibly be utilized.

One feature of the invention resides broadly in the hinge for connecting adjacent wall or door elements which can be folded toward one another until parallel, and which wall or door elements have on their end faces connecting elements arranged such that two opposing connecting elements are connected by means of crossed connecting rods seated in grooves, and the opposing end faces of the connecting elements are convex so as to create a small air gap, characterized by the fact that the wall 14 of the connecting element 9, which wall 14 also forms the bottom 13 of a groove, has a penetration 18 through which the retainer shank 16 of a retainer 15 is passed, which retainer shank 16 can be fixed in or to the element 1, 2 or add-on pieces of the same, and the retainer 15 has a retainer head 17 which is wider than the retainer shank 16, which retainer head 17 when resting on the bottom 13 of the groove serves as or supports the axle arms 19, 19' of the connecting rods 11, 11'.

Another feature of the invention resides broadly in the hinge characterized by the fact that the opposing outer surfaces 20 of the retainer heads 17 have the same contour as the opposing outer surfaces (end faces 12) of the connecting elements.

Yet another feature of the invention resides broadly in the hinge characterized by the fact that one of each pair of crossed connecting rods 11, 11' is seated within a groove 10 between a plane surface 21 of the retainer head 17 and a plane surface 22 of the connecting element 9.

Still another feature of the invention resides broadly in the hinge characterized by the fact that the retainer shank 16 has a square or rectangular cross-section.

A further feature of the invention resides broadly in the hinge characterized by the fact that the retainer shank 16 has bores, preferably threaded bores 23, for connection to the element 1, 2.

Another feature of the invention resides broadly in the hinge characterized by the fact that the connecting elements 9 are divided into two mirror-image halves 9', 9" to each form one half of a convex end face 12.

Yet another feature of the invention resides broadly in the hinge characterized by the fact that the halves 9', 9" of the connecting elements 9 can be bolted together.

Still another feature of the invention resides broadly in the hinge characterized by the fact that the connecting element 9 has a slot 25 for an element 1, 2, preferably for a pane of glass 6.

A further feature of the invention resides broadly in the hinge characterized by the fact that the connecting rods 11, 11' are crossed to form an X with an included angle of approximately 52° when the adjacent elements 1, 2 are flush, and the bisecting line of this angle is formed by the center longitudinal axis M of the elements 1, 2, and that the opposing end faces 12 of the connecting elements are semicircular.

To further explain the instant invention, one possible embodiment relates to a hinge for connecting adjacent wall or door elements which can be folded toward one another until parallel, and which wall or door elements have on their end faces connecting elements arranged such that two opposing connecting elements are connected by means of crossed connecting rods seated in grooves, and the opposing end faces of the connecting elements are convex so as to create a small air gap.

The invention also relates to a hinge for connecting wall or door elements which can be swung toward one another until parallel, with the hinge having crossed and stacked connecting arms seated in or braced against connecting elements fastened to the door or wall element. The inventive idea is that the hinge has a retainer which passes through a penetration in one wall of the connecting element. This retainer can be connected to the wall or door element by means of a retainer shank, and also separates the connecting rods as well as forms or supports the axle arms of the connecting rods.

Some examples of hinges which may be utilized or incorporated in an embodiment of the present invention may be found in U.S. Pat. No. 5,410,779, issued to inventors Esman et al. on May 2, 1995; U.S. Pat. No. 4,914,782, issued to inventor Rupprechter on Apr. 10, 1990; U.S. Pat. No. 5,150,501, issued to inventor Pasternak on Sep. 29, 1992; U.S. Pat. No. 4,999,876, issued to inventor Nass on Mar. 19, 1991; U.S. Pat. No. 5,174,703, issued to inventor White on Dec. 29, 1992; and U.S. Pat. No. 5,715,573, issued to inventor Holemans on Feb. 10, 1998.

Some examples of foldable doors and mechanisms and devices for their operation which may be utilized or incorporated in an embodiment of the present invention may be found in U.S. Pat. No. 5,186,230, issued to inventor Ostrander on Feb. 16, 1993; U.S. Pat. No. 4,932,455, issued to inventor Yamada on Jun. 12, 1990; and U.S. Pat. No. 5,099,903, issued to inventor Chen on Mar. 31, 1992.

Some examples of movable partition or wall systems and devices for their operation which may be utilized or incorporated in an embodiment of the present invention may be found in U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillman on May 23, 1995; and U.S. Pat. No. 5,544,462, issued to inventor Kordes on Aug. 13, 1996.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 197 04 490, filed on Feb. 7, 1997, having inventor Reinhard Janutta, and DE-OS 197 04 490 and DE-PS 197 04 490 and International Application No. PCT/EP98/00615, filed on Feb. 5, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

AT LEAST PARTIAL NOMENCLATURE

1 Element
2 Element
3 Hanger element
4 Runner rail
5 Door rail
5' Door rail
6 Pane of glass
7 Hinge
8 End face of the wall or door element
9 Connecting element
9' Half of a connecting element
9" Half of a connecting element
10 Groove
11 Upper connecting rod
11' Lower connecting rod
12 End faces of the connecting elements
13 Bottom of groove
14 Wall of the connecting element
15 Retainer

16 Retainer shank
17 Retainer head
18 Penetration
19 Upper axle arm
19' Lower axle arm
20 Outer surface of the retainer head
21 Plane surface of the retainer head
22 Plane surface of the connecting element
23 Threaded bore in retainer shank
24 Bore
25 Slot
26 Supporting surface of the retainer head
X Air gap
M Center longitudinal axis
Y Space

What is claimed is:

1. A wall or partition system, said wall or partition system comprising:

at least two partition elements;

said at least two partition elements comprising at least one pair of partition elements disposed adjacent one another;

at least one connecting arrangement being configured and disposed to connect said at least one pair of adjacent partition elements;

said at least one connecting arrangement comprising:

at least one supporting arrangement being configured and disposed to support the weight of one of said at least one pair of adjacent partition elements;

at least one other supporting arrangement being configured and disposed to support the weight of the other one of said at least one pair of adjacent partition elements;

at least two connecting rods;

said at least two connecting rods being configured and disposed to connect said at least one supporting arrangement to said at least one other supporting arrangement;

said at least two connecting rods and said supporting arrangements being configured and disposed to permit at least one partition element of said at least one pair of adjacent partition elements to be folded to a substantially parallel position, one with respect to the other;

each of said at least two connecting rods having a longitudinal axis;

said longitudinal axes of each of said at least two connecting rods being disposed substantially transverse to one another;

each of said supporting arrangements comprising:

a connecting element being configured and disposed to connect each of said supporting arrangements to its corresponding partition element;

said connecting element comprising:

a recessed portion; and said recessed portion comprising an opening disposed therein;

a retainer being configured and disposed to retain said connecting element; and said retainer comprising:

a retainer shank;

a retainer head;

said retainer shank being configured and disposed to pass through said opening in said connecting element; and said retainer shank being inserted in its corresponding partition element;

each said retainer having a length and a width, said length being greater than said width;

the width of each said retainer at said retainer head being greater than the width of each said retainer at said retainer shank;

each said recessed portion comprising:

an end wall portion;

said end wall portion being disposed immediately adjacent its corresponding partition element;

said opening in each said recessed portion being disposed in said end wall portion;

a first side wall portion;

a second side wall portion; and said first side wall portion and said second side wall portion being disposed substantially perpendicular to said end wall portion and disposed to face one another; and each said retainer head being disposed against said end wall portion and between said side wall portions of a corresponding recessed portion.

2. The wall or partition system according to claim 1, wherein:

each of said at least two connecting rods comprises a first end portion and a second end portion, said first end portion is disposed opposite said second end portion;

each of said end portions comprises an opening;

each said retainer head comprises at least two axle arms;

said at least two axle arms are disposed to project from each said retainer head substantially toward said side wall portions of said corresponding recessed portion; and said opening in each of said end portions is configured and disposed to receive an axle arm of said at least two axle arms to permit said at least two connecting rods to rotate about said at least two axle arms.

3. The wall or partition system according to claim 2, wherein:

said at least two connecting rods of each of said at least one connecting arrangement comprise a first connecting rod and a second connecting rod;

said at least one supporting arrangement of each of said at least one connecting arrangement comprises a first supporting arrangement;

said at least one other supporting arrangement of each of said at least one connecting arrangement comprises a second supporting arrangement;

said first end portion of said first connecting rod is disposed between said first side wall portion and said retainer head of said first supporting arrangement;

said second end portion of said first connecting rod is disposed between said first side wall portion and said retainer head of said second supporting arrangement;

said first end portion of said second connecting rod is disposed between said second side wall portion and said retainer head of said first supporting arrangement; and said second end portion of said second connecting rod is disposed between said second side wall portion and said retainer head of said second supporting arrangement.

4. The wall or partition system according to claim 3, wherein:

each said retainer head comprises an end face; and said end face of said retainer head of said first supporting arrangement is disposed to face opposite said end face of said retainer head of said second supporting arrangement.

5. The wall or partition system according to claim 4, wherein:

each said connecting element comprises an end face;

said end face of said connecting element of said first supporting arrangement is disposed to face opposite said end face of said connecting element of said second supporting arrangement; and said end face of each said retainer head having substantially the same contour as said end face of a corresponding connecting element.

6. The wall or partition system according to claim 5, wherein:

said contour of said end faces is substantially convex;

each said connecting element comprises two halves; and said two halves are configured and disposed to be connected together to form a single connecting element.

7. The wall or partition system according to claim 6, wherein:

each said connecting element comprises a slot; and said slot is configured and disposed to receive and hold a portion of its corresponding partition element.

8. The wall or partition system according to claim 7, wherein:

each said retainer shank has a cross-section having a substantially rectangular shape;

each said retainer shank comprises bores; and said bores are configured and disposed to connect each said retainer shank to its corresponding partition element.

9. The wall or partition system according to claim 8, wherein:

said portion of said corresponding partition element held by said slot comprises a pane of glass;

said first and said second connecting rods form an X-shape upon said end faces of said connecting elements of each said pair of adjacent partition elements being disposed facing opposite one another;

said X-shape includes an angle of about 52 degrees;

said angle has a line of bisection; and said line of bisection runs substantially parallel to the length dimension of said rectangular retainer shank.

10. A connecting arrangement for connecting partition elements disposed adjacent one another, said connecting arrangement comprising:

at least one supporting arrangement being configured to support the weight of a partition element;

at least one other supporting arrangement being configured to support the weight of a partition element;

at least two connecting rods;

said at least two connecting rods being configured and disposed to connect said at least one supporting arrangement to said at least one other supporting arrangement;

said at least two connecting rods and said supporting arrangements being configured to permit a corresponding partition element of each of said supporting arrangements to be folded toward each other to a substantially parallel position, one with respect to the other;

each of said at least two connecting rods having a longitudinal axis;

said longitudinal axes of each of said at least two connecting rods being disposed substantially transverse to one another;

each of said supporting arrangements comprising:

a connecting element being configured to connect each of said supporting arrangements to a corresponding partition element;

said connecting element comprising:

a recessed portion; and said recessed portion comprising an opening disposed therein;

a retainer being configured and disposed to retain said connecting element; and said retainer comprising:

a retainer shank;

a retainer head;

said retainer shank being configured to pass through said opening in said connecting element; and said retainer shank also being configured to be inserted into a corresponding partition element;

each said retainer having a length and a width, said length being greater than said width;

the width of each said retainer at said retainer head being greater than the width of each said retainer at said retainer shank;

each said recessed portion comprising:

an end wall portion;

said opening in said recessed portion being disposed in said end wall portion;

a first side wall portion;

a second side wall portion; and said first side wall portion and said second side wall portion being disposed substantially perpendicular to said end wall portion and disposed to face one another; and each said retainer head being configured to be disposed against said end wall portion and between said side wall portions of a corresponding recessed portion.

11. The connecting arrangement according to claim 10, wherein:

each of said at least two connecting rods comprise a first end portion and a second end portion, said first end portion is disposed opposite said second end portion;

each of said end portions comprises an opening;

said retainer head comprises at least two axle arms;

said at least two axle arms are disposed to project from each said retainer head substantially toward said side wall portions of said corresponding recessed portion; and said opening in each of said end portions is configured to receive an axle arm of said at least two axle arms to permit said at least two connecting rods to rotate about said at least two axle arms.

12. The connecting arrangement according to claim 11, wherein:

said at least two connecting rods comprise a first connecting rod and a second connecting rod;

said at least one supporting arrangement of each of said at least one connecting arrangement comprises a first supporting arrangement;

said at least one other supporting arrangement of each of said at least one connecting arrangement comprises a second supporting arrangement;

said first end portion of said first connecting rod is disposed between said first side wall portion and said retainer head of said first supporting arrangement;

said second end portion of said first connecting rod is disposed between said first side wall portion and said retainer head of said second supporting arrangement;

said first end portion of said second connecting rod is disposed between said second side wall portion and said retainer head of said first supporting arrangement; and said second end portion of said second connecting rod is disposed between said second side wall portion and said retainer head of said second supporting arrangement.

13. The connecting arrangement according to claim 12, wherein:

each said retainer head comprises an end face; and said end face of said retainer head of said first supporting arrangement is disposed to face opposite said end face of said retainer head of said second supporting arrangement.

14. The connecting arrangement according to claim 13, wherein:

each said connecting element comprises an end face;

said end face of said connecting element of said first supporting arrangement is disposed to face opposite said end face of said connecting element of said second supporting arrangement; and said end face of each said retainer head having substantially the same contour as said end face of a corresponding connecting element.

15. The connecting arrangement according to claim 14, wherein:

said contour of each said end faces is substantially convex;

each said connecting element comprises two halves; and said two halves are configured to be connected together to form a single connecting element.

16. The connecting arrangement according to claim 15, wherein:

each said connecting element comprises a slot; and said slot is configured to receive and hold a portion of a corresponding partition element.

17. The connecting arrangement according to claim 16, wherein:

each said retainer shank has a cross-section having a substantially rectangular shape;

each said retainer shank comprises bores; and said bores are configured to connect each said retainer shank to a corresponding partition element.

18. The connecting arrangement according to claim 17, wherein:

said slot is configured to receive and hold a pane of glass of a corresponding partition element;

said first and said second connecting rods form an X-shape upon said end faces of said connecting elements of a pair of adjacent partition elements being disposed facing opposite one another;

said X-shape includes an angle of about 52 degrees;

said angle has a line of bisection; and said line of bisection runs substantially parallel to the length dimension of said rectangular retainer shank.

* * * * *